United States Patent [19]

Crisci

[11] 4,209,107

[45] Jun. 24, 1980

[54] CONTAINER WITH VAPOR LOCK CLOSURE

[76] Inventor: Victor E. Crisci, 49 Heritage La., Leominister, Mass. 01453

[21] Appl. No.: 960,864

[22] Filed: Nov. 15, 1978

[51] Int. Cl.[2] ..... B65D 43/06; B65D 51/12

[52] U.S. Cl. ..... 220/306; 220/355

[58] Field of Search ..... 220/306, 355, 356

[56] References Cited

U.S. PATENT DOCUMENTS

| | | | |
|---|---|---|---|
| 3,373,896 | 3/1968 | Davis | 206/508 X |
| 3,519,163 | 7/1970 | Bardell | 220/306 |
| 3,556,338 | 1/1971 | Wilkinson et al. | 220/306 |
| 3,743,133 | 7/1973 | Rathbun | 220/306 |
| 4,004,710 | 1/1977 | Crisci | 220/356 |

*Primary Examiner*—Steven M. Pollard

*Attorney, Agent, or Firm*—McAulay, Fields, Fisher & Goldstein

[57] ABSTRACT

A container with closure, in which the container has an annular tapered ridge disposed below its upper edge, and the closure has an inverted U-shaped groove with side walls sized and shaped to sealingly contact the container body at 4 surfaces. The U-shaped groove is sized slightly smaller than the portion of the container body received therein and includes a wedging portion whereby the groove walls clamp the container body side wall and is driven into tight abutment with the side wall by the wedging forces. The result is a vapor lock closure which is tightly secured to the container.

4 Claims, 5 Drawing Figures

CONTAINER WITH VAPOR LOCK CLOSURE

BACKGROUND OF THE INVENTION

There is a constant demand for vapor lock sealed containers for many industrial uses. These uses include storage and shipping of such diverse materials as paint, clams, pickles, mastics, vinyl adhesives, automobile dent filler, caulking compounds, swimming pool chemicals, mayonnaise, peanut butter, and many other liquids, pastes and solids. For most of these applications it is important that the lid be securely retained on the container body and form an air-tighte closure therewith. It is also important that the closure be removable and resealable enough times to permit use of the contents without destruction of the air tight seal.

For some of these applications, metal-paint cans have been used. These cans normally have an upwardly open groove formed in the upper portion of the body thereof into which a lip on the can is inserted. This type of container has a number of draw backs, including the fact that the air-tight seal is often deformed as a result of the opening of the can with a screwdriver or other similar device. In addition, the groove formed in the container retains any materials which fall into it, which materials, upon hardening, make an air tight closure almost impossible. If the top is pressed on before the materials harden, they often squirt out unto the user of the container or the floor. There are containers available which have a receiving groove formed on the closure, and thereby avoid some of the problems of the usual paint can type of container. Examples of this type of container are disclosed in U.S. Pat. No. 4,004,710; U.S. Pat. No. 4,079,857; and U.S. Pat. No. 4,078,696, all by the present inventor Victor Eugene Crisci.

The containers disclosed in these three patents are generally the type of container with which the present invention is concerned, however, these containers do not utilize the combination clamping and wedging action of the present invention to attain a vapor locked seal forming four separate contact surfaces.

U.S. Pat. No. 4,004,710, provides a fluid-tight seal between the container and the lid by peripheral contact under pressure between a convex inner edge of the container lip and a splayed surface within a peripheral, inverted U-groove in the lid. Sealing pressure is provided by co-action between complimentary sloping surfaces on the container lip and within the lid peripheral groove respectively which tends to draw the lid in a closing direction. As can be seen in FIG. 2, this provides two diametrically opposed contact surfaces with a relatively large clearance space therebetween. U.S. Pat. No. 4,078,696 features a resilient seal in the form of an O-ring gasket 11 which, as can be seen by comparing FIGS. 2 and 3, is deformed to form a closure seal. The device shown in this patent is otherwise similar to the one shown in U.S. Pat. No. 4,004,710, and is intended to obtain a positive seal and position seat for such a closure. U.S. Pat. No. 4,079,057, teaches a closure with three contact surfaces with a space formed between the fourth surfaces.

BRIEF DESCRIPTION

A container according to the present invention has a container body and a plastic closure. The upper portion of the container body carries a tapered ridge disposed below its upper edge.

The plastic closure has an inverted U-shaped groove which fits over the upper portion of the container body and co-acts therewith to form a four contact vapor locked seal.

Because the width of the U-shaped groove is slightly smaller than the width of the upper portion of the container body, the groove clamps the inner wall of the container and the outer, upper edge surface of the ridge formed about the container. There is also a wedge-like edge on the groove which co-acts with a matching surface on the lower part of the ridge to jam the container body into contact with the bottom of the inverted U-shaped groove. This results in the four surface contact seal and in securely locking together the container closure and the container body.

BRIEF DESCRIPTION OF THE DRAWINGS

For a better understanding of the operation of the invention, reference is now made to the drawings wherein.

DESCRIPTION OF THE PREFERRED EMBODIMENT

Figure 1:
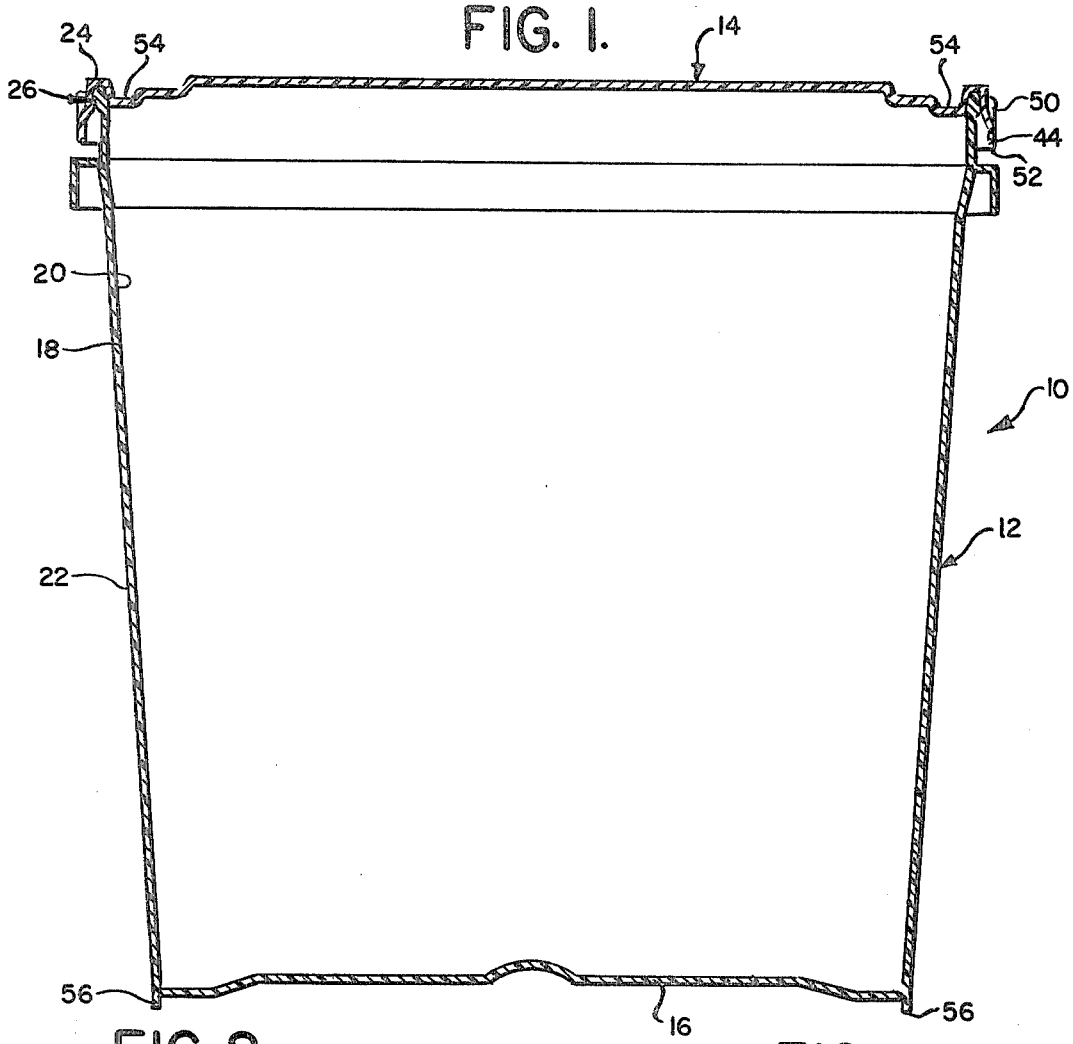
FIG. 1 is a sectional view of a container according to the present invention, showing the plastic closure in place on the container body.

With reference to FIG. 1, a container 10 has a container body 12 and a plastic closure 14.

The container body includes a base 16 and an annular side wall 18. The annular side wall 18 is of a thickness depending on the strength required of the container and has inner surface 20 and outer surface 22 with an upper edge surface 24.

Figure 3:
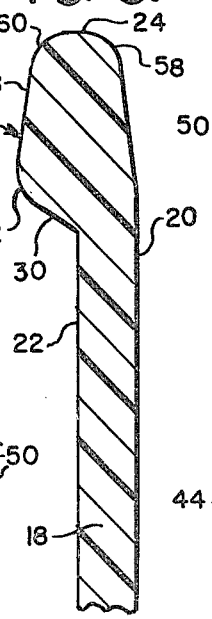
FIG. 3 is a partial sectional view of the container body showing the upper portion thereof in detail.

Disposed below and extending from the upper edge surface 24 is an annular tapered ridge 26. As is shown in FIG. 3, the annular tapered ridge 26 has an upper ridge surface 28 which extends downwardly and outwardly from the upper edge surface 24. A lower ridge surface 30 extends from the outer end of the upper ridge surface 28, in a direction downwardly and inwardly from the upper ridge surface to a portion of the outer wall surface 22.

Figure 2:
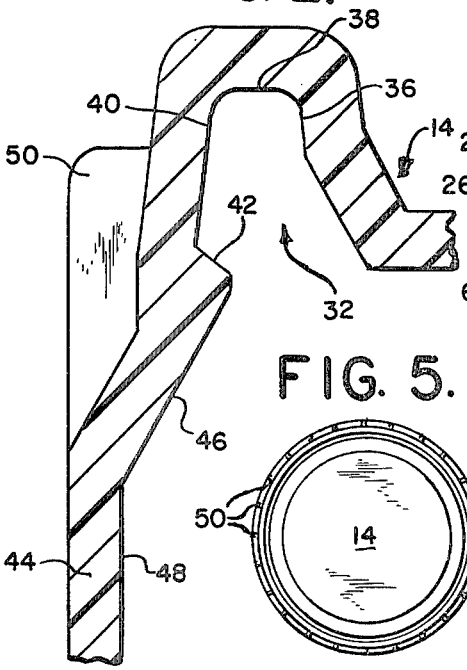
FIG. 2 is an enlarged partial sectional view of the closure, showing the vapor lock seal in detail.
Figure 4:
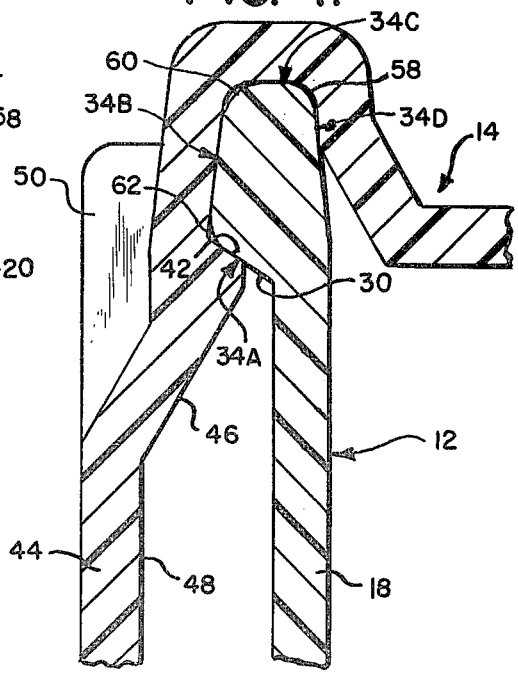
FIG. 4 is a partial sectional view of the interaction of the various portions of the closure and the container body to form the four contact vapor-lock.
Figure 5:
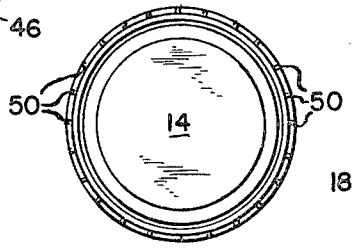
FIG. 5 is a top plan view of the container of FIG. 1.

With reference to FIG. 2, the plastic closure 14 forms a generally U-shaped annular groove 32 which, as can be seen in FIG. 4, is sized and shaped to sealingly contact the container body 12 at four sealing points 34A, B, C and D. More specifically, the closure 14 has a generally upwardly extending first contact surface 36; a generally horizontal second contact surface 38 extending outwardly from the first contact surface; a generally vertical third contact surface 40 extending generally downwardly from the second contact surface 38; and a downwardly and inwardly extending fourth contact surface 42 extending from the end of the third contact surface 40. As can be seen in FIG. 4 these surfaces generally confine the upper end of the container body.

The closure 14 is preferably more of a suitable resilient plastic such as high or low density polyethylene. This type of plastic material provides the necessary resiliency or "springiness" to the closure 14. The second contact surface 38 of the closure is made slightly smaller than the upper edge surface 24 of the container body so that the first and third (36, 40) contact surfaces will clamp the inner surface on the annular side wall 18 and the upper ridge surface 28, therebetween. Similarly, the third contact surface 40 is made slightly smaller than the upper ridge surface against which it is clamped. This forces the fourth contact surface 42 to generate wedging or jamming forces with respect to the lower ridge surface 30, as is obvious from FIG. 4, thereby jamming or forcing the second contact surface into engagement with the upper edge surface 24, to form sealing point 34C. In this manner, a vapor lock seal is formed and is ensured by four separately engaged surfaces forming sealing points 34A, B, C and D.

The result of the combined clamping and wedging action of the closure 14 with the container body 12, is not only to form a vapor locked seal, but also to firmly secure the closure to the container body against accidential opening. It has been found that the combined clamping and wedging action will prevent the plastic closure 14 from becoming disengaged from the container body 12 even when the container is filled with paint or other similar liquid, and dropped in a manner which may accidently occur during normal use.

For purposes wherein the container is to be used for light weight materials such as various food stuffs—mayonnaise, salad dressing or the like—it is usual to form the closure of low density polyethylene. The seal is somewhat easier to peel open when the closure 14 is made of the softer material. When the closure is made of a material such as high density polyethylene, it is necessary to use a screwdriver to open the seal. In either case, no damage occurs to the closure 14 in normal use and the vapor locked seal is not destroyed. Nor does repeated openings and closings destroy the seal formed by the closure 14 and the container body 12.

The preferred embodiment enclosure also includes a closure guide 44 which extends outwardly from the fourth contact surface 42. The guide 44 includes an inclined guide surface 46 and a downwardly extending portion 48. The closure guide permits the closure to be dropped unto a container body 12 and become automatically properly aligned for sealing. A roller or other similar device can be used in a conveyor belt type arrangement to consecutively seal containers without any special alignment procedures with respect to the container body 12 and their closure 14.

Another preferred feature for the closure 14 are fins 50 extending partway to the upper edge of the closure 14. This allows the covers to be easily stacked, and keeps them lined up for ease of handling, by supporting the bottom 52 of closure guide 44 of another closure thereon. Each closure 14 is also preferably provided with a stacking groove 54 which receives an extension portion 56 of the side wall 18 which extends below base 16 (FIG. 1). When the containers 10 are stacked, the extension portion 56 rests in the stacking groove 54 to permit high stacking without collapse of the containers, and with good stability.

The present invention container 10 is particularly adapted for manufacture by injection molding techniques. In order to neutralize problems encountered in uneven shrinking, and thereby ensure four contact point sealing, the corners between the various contact surfaces 20, 24, 28 and 30, respectively indicated at 58, 60 and 62 in FIG. 3, are slightly rounded. This provides for an approximately 3–5 mil clearance at each of these corners when the closure 14 is sealed on the container body 12, as is shown exaggerated in FIG. 4.

While there have been shown what are considered to be the preferred embodiments of the invention, it will be obvious to those skilled in the art that various changes and modifications may be made therein without departing from the scope of the invention.

What is claimed is:

1. A container comprising a container body; and a plastic closure;

said container body having a base, an annular side wall with inner and outer surfaces, and an upper edge surface;

said side wall including an annular tapered ridge extending down from said upper edge surface;

said upper edge surface having inner and outer rounded corners;

said ridge having an upper ridge surface extending downwardly and outwardly from said outer corner of said upper edge and a lower ridge surface extending downwardly and inwardly from said upper ridge surface to said outer surface of said side wall; and a rounded third corner between said upper and lower ridge surfaces;

said closure having an inverted, generally U-shaped annular groove and a closure guide extending outwardly and downwardly from the lower end of the outer wall of said groove;

said groove having an inner wall, an upper wall, an outer wall and a re-entrant wall to define respectively first, second, third and fourth contact surfaces, said surfaces being sized and shaped to sealingly contact said container body at said inner wall surface, said upper edge surface, said upper ridge surface and said lower ridge surface, respectively;

said second contact surface being slightly smaller than said upper edge to cause said first and third contact surfaces to clamp said side wall therebetween;

said third contact surface being slightly smaller than said upper ridge surface to cause said fourth contact surface and said lower ridge surface to generate wedging forces therebetween and drive said closure into tight abutment with said container at said four contact surfaces, securing said closure to said container;

said inner, outer and third rounded corners of said container body being slightly spaced from corresponding corners of said groove of said closure, when said closure is mounted on said container body, to provide a space for adjustment of said groove on said edge of said container body and to assure a sealing relationship between closure and container body at all four of said contact surfaces;

said closure guide including an inclined guide wall portion extending downwardly and outwardly from said groove and also including a vertical wall portion extending downwardly from said inclined guide wall portion, the inner surface of said vertical wall portion being radially outward of the outer surface of said outer wall portion of said groove;

said closure also including a plurality of substantially vertical fins, each of said fins extending radially outward from said outer wall portion of said groove and from said guide wall portion, each of said fins extending upwardly from the outer surface of said guide wall portion, each of said fins having an upper surface positioned below the upper edge of said outer wall portion of said groove, said upper edge of said fins contacting the lower edges of said vertical wall portion of said closure guide when a plurality of said closures are stacked, said upper edges of said fins providing the sole support for successive closures being stacked.

2. The container of claim 1 wherein said clearance is approximately three to five mils.

3. The container of claim 1 or 2 wherein said side wall has a portion extending below said base to form an annular collar; and said closure includes an annular stacking groove formed therein to receive said annular collar, thereby to provide for a stable stack of said containers.

4. The container of claim 3 wherein said container is formed of high density polyethylene.

* * * * *